US010286281B2

(12) United States Patent
Baumberger et al.

(10) Patent No.: US 10,286,281 B2
(45) Date of Patent: May 14, 2019

(54) VOLLEYBALL TRAINING DEVICE

(71) Applicants: Ralph Baumberger, Dennison, OH (US); Denise Baumberger, Dennison, OH (US)

(72) Inventors: Ralph Baumberger, Dennison, OH (US); Denise Baumberger, Dennison, OH (US)

( * ) Notice: Subject to any disclaimer, the term of this patent is extended or adjusted under 35 U.S.C. 154(b) by 0 days.

(21) Appl. No.: 15/704,485

(22) Filed: Sep. 14, 2017

(65) Prior Publication Data

US 2019/0076719 A1 Mar. 14, 2019

(51) Int. Cl.

*A63B 69/00* (2006.01)
*A63B 69/38* (2006.01)
*A63B 71/02* (2006.01)

(52) U.S. Cl.

CPC ..... *A63B 69/0075* (2013.01); *A63B 69/0095* (2013.01); *A63B 71/023* (2013.01); *A63B 2071/026* (2013.01); *A63B 2225/093* (2013.01)

(58) Field of Classification Search

CPC ..... A63B 69/0075; A63B 69/0095; A63B 71/023; A63B 2071/026; A63B 2225/093
USPC ..... 473/422, 433, 459, 460, 462, 466, 473
See application file for complete search history.

(56) References Cited

U.S. PATENT DOCUMENTS 3,897,950 A 8/1975 Keller
4,022,471 A * 5/1977 Keller ..... A63B 61/006 473/473
4,296,925 A 10/1981 Alston
4,881,742 A * 11/1989 Hargreave ..... A63B 69/0091 473/575
4,887,821 A * 12/1989 Greene ..... A63B 69/0075 473/459
4,948,150 A 8/1990 Daly, Jr. et al.
5,060,946 A * 10/1991 Taylor ..... A63B 69/0079 473/429
5,238,251 A 8/1993 Staka
5,692,978 A * 12/1997 Hummel ..... A63B 61/006 473/459
D486,544 S * 2/2004 Featherston ..... D21/719
7,041,016 B1 5/2006 Omtvedt
D606,136 S 12/2009 Gambona
7,824,282 B2 * 11/2010 Wycoff ..... A63B 61/006 473/423

(Continued)

FOREIGN PATENT DOCUMENTS

WO WO2007053054 10/2007

*Primary Examiner* — Mitra Aryanpour

(57) ABSTRACT

A volleyball training device for practicing spiking of a volleyball includes a base that is configured to position on a substantially horizontal surface. A plurality of nested rods, which is selectively vertically extensible, is coupled to and extends perpendicularly from a first end of the base. A first rod is coupled to and extends perpendicularly from an upper end of the nested rods. The first rod is opposed to the base. A coupler is coupled to and extends downwardly from the first rod distal from the nested rods. A lattice is selectively couplable to and extends from the plurality of nested rods. The lattice is selectively positionable between the base and the coupler. The coupler is configured to selectively couple to a volleyball to position the volleyball to be spiked by a user. The lattice is configured to simulate a volleyball net.

14 Claims, 7 Drawing Sheets

(56) References Cited

U.S. PATENT DOCUMENTS

| | | | | |
|---|---|---|---|---|
| 7,998,003 | B2 * | 8/2011 | Orr | A63B 69/0079 473/422 |
| 8,371,964 | B2 * | 2/2013 | Jones | A63B 69/0095 473/422 |

* cited by examiner

VOLLEYBALL TRAINING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to training devices and more particularly pertains to a new training device for practicing spiking of a volleyball.

BRIEF SUMMARY OF THE INVENTION

An embodiment of the disclosure meets the needs presented above by generally comprising a base that is configured to position on a substantially horizontal surface. A plurality of nested rods, which is selectively vertically extensible, is coupled to and extends perpendicularly from a first end of the base. A first rod is coupled to and extends perpendicularly from an upper end of the nested rods. The first rod is opposed to the base. A coupler is coupled to and extends downwardly from the first rod distal from the nested rods. A lattice is selectively couplable to and extends from the plurality of nested rods. The lattice is selectively positionable between the base and the coupler. The coupler is configured to selectively couple to a volleyball to position the volleyball to be spiked by a user. The lattice is configured to simulate a volleyball net.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
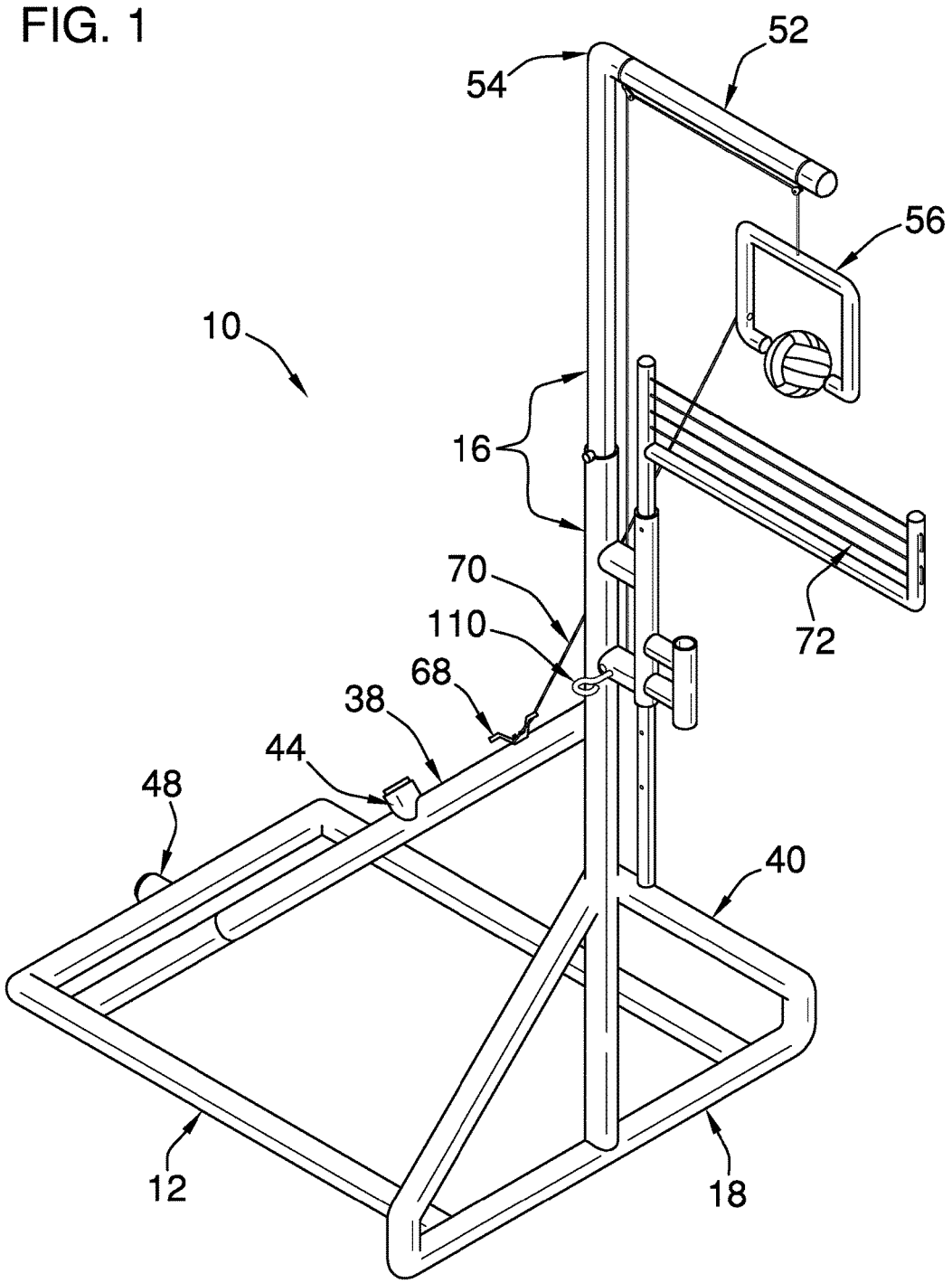
FIG. 1 is an isometric perspective view of a volleyball training device according to an embodiment of the disclosure.
Figure 2:
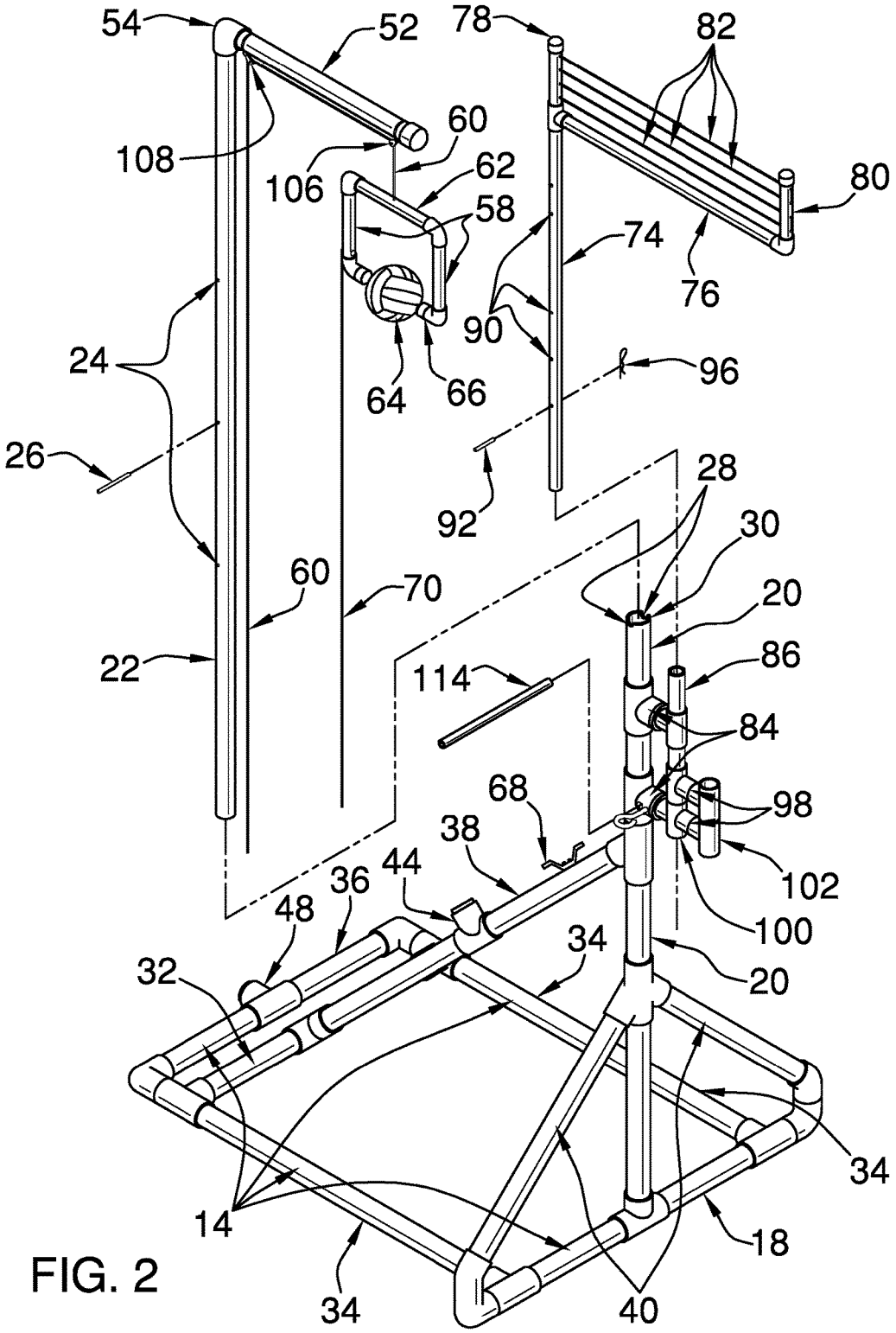
FIG. 2 is an exploded view of an embodiment of the disclosure.
Figure 3:
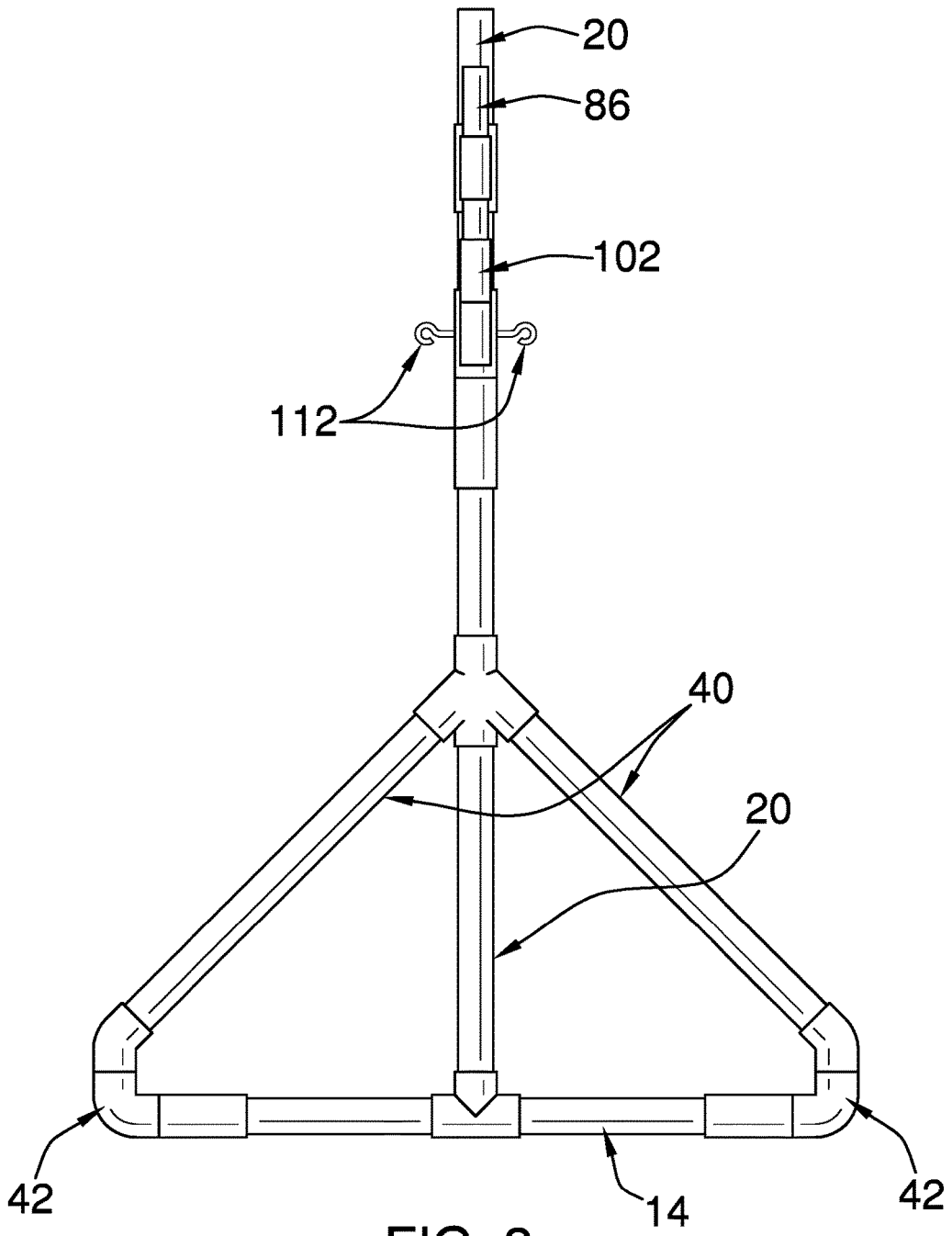
FIG. 3 is a front view of an embodiment of the disclosure.
Figure 4:
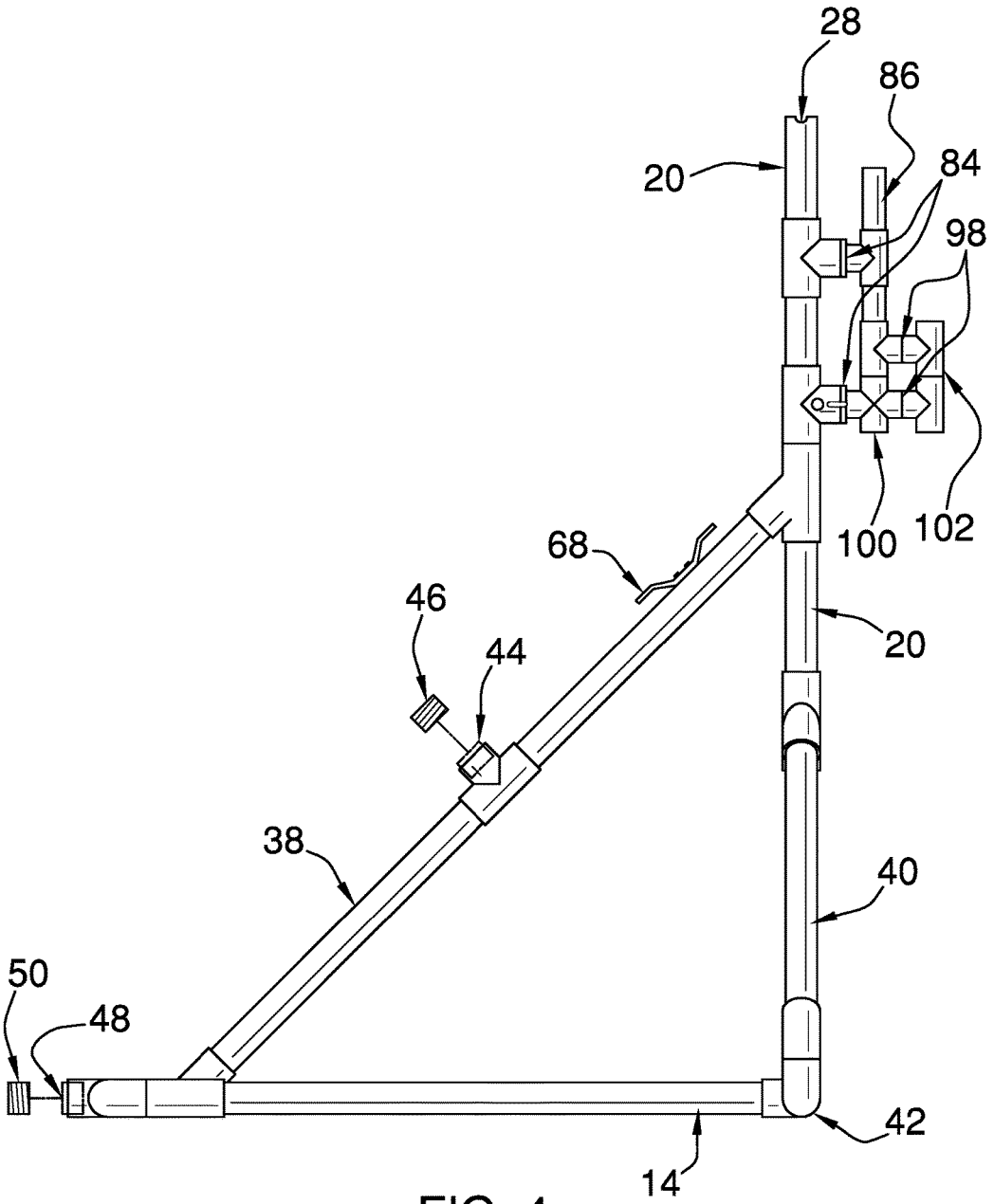
FIG. 4 is a side view of an embodiment of the disclosure.
Figure 5:
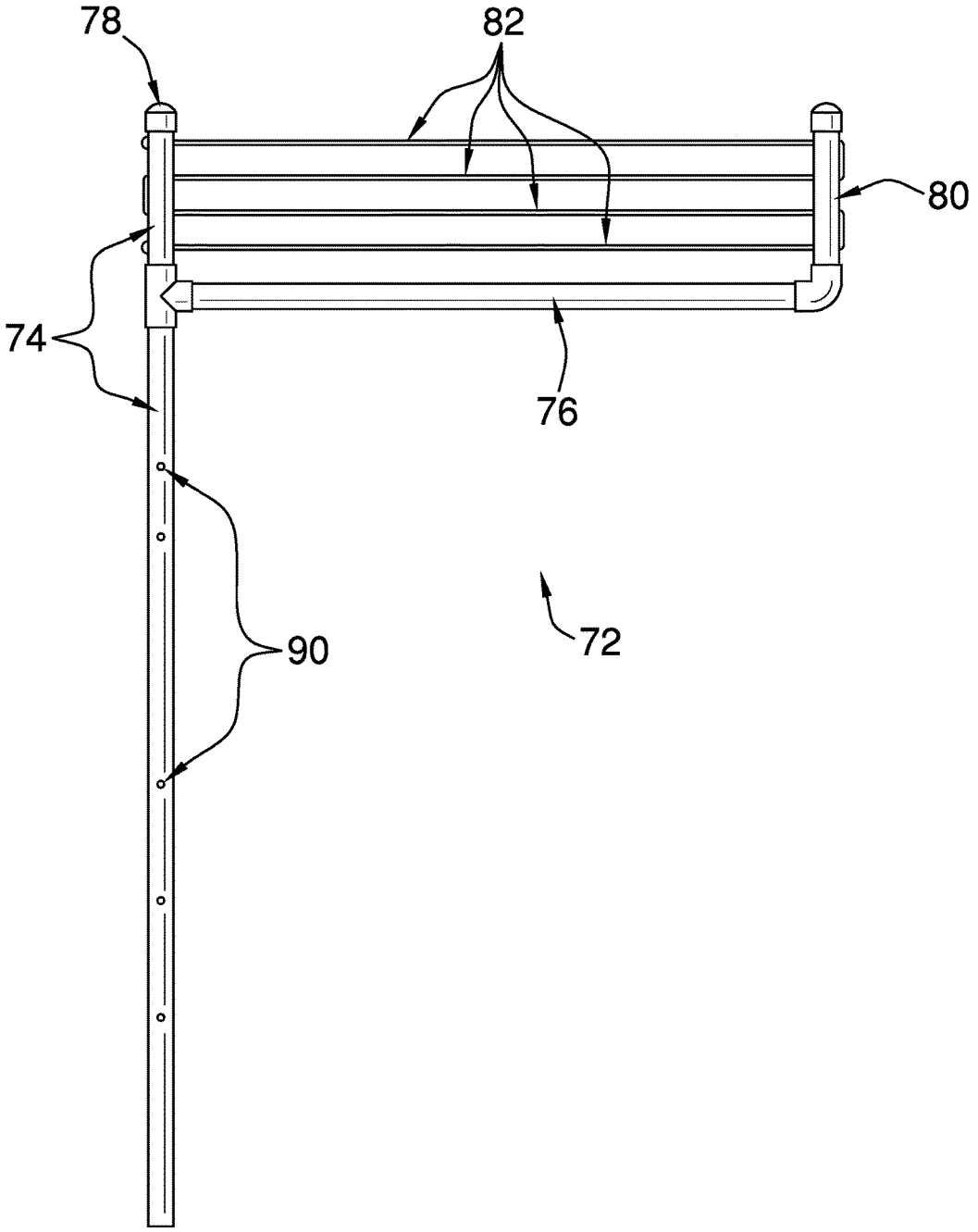
FIG. 5 is a side view of an embodiment of the disclosure.
Figure 6:
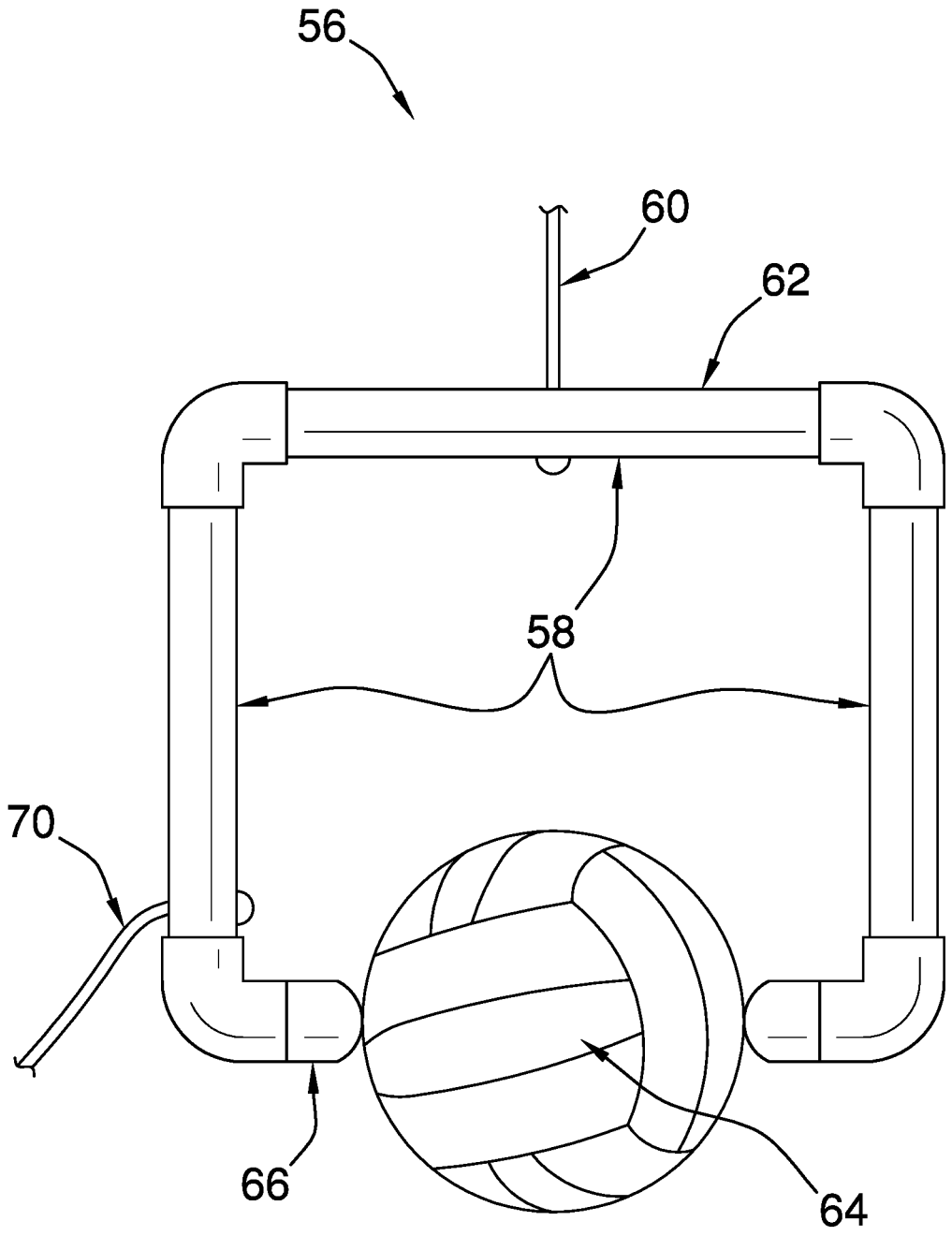
FIG. 6 is a side view of an embodiment of the disclosure.
Figure 7:
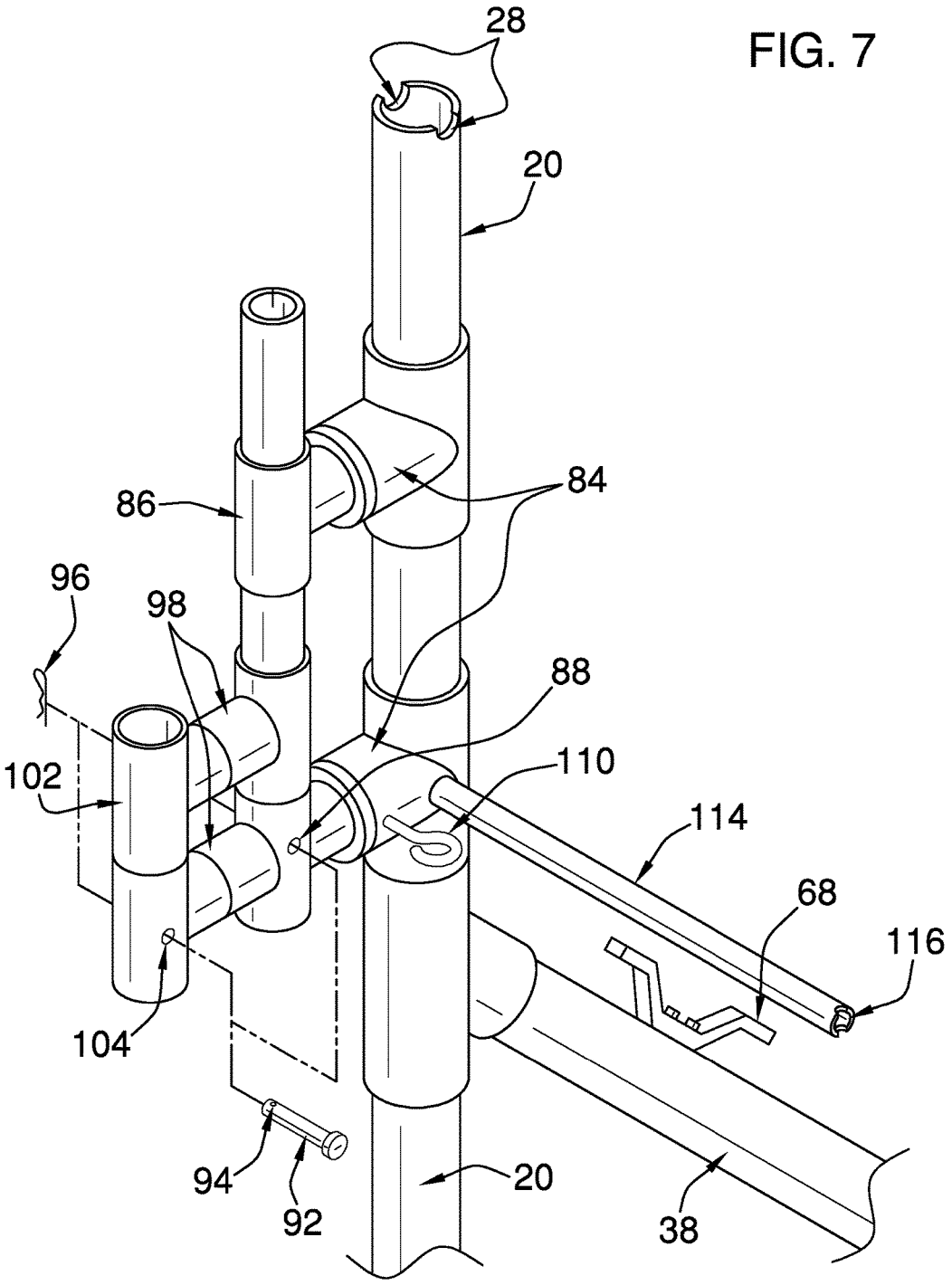
FIG. 7 is an isometric perspective view of an embodiment of the disclosure.

With reference now to the drawings, and in particular to FIGS. 1 through 7 thereof, a new training device embodying the principles and concepts of an embodiment of the disclosure and generally designated by the reference numeral 10 will be described.

As best illustrated in FIGS. 1 through 7, the volleyball training device 10 generally comprises a base 12 that is configured to position on a substantially horizontal surface. In one embodiment, the base 12 comprises a first frame 14. The first frame 14 is tubular and substantially rectangularly shaped.

A plurality of nested rods 16 is coupled to and extends perpendicularly from a first end 18 of the base 12. The plurality of nested rods 16 is selectively vertically extensible. In one embodiment, the plurality of nested rods 16 comprises a first tube 20 and a second tube 22. The first tube 20 is fluidically coupled to the first frame 14. The second tube 22 is selectively extensible from the first tube 20.

A plurality of penetrations 24 is positioned through the second tube 22. Each penetration 24 is positioned to insert a first pin 26 to fixedly position the plurality of nested rods 16 at a respective height. The first pin 26 is complementary to the penetrations 24.

A pair of cutouts 28 is opposingly positioned in an upper endpoint 30 of the first tube 20. The cutouts 28 are complementary to the first pin 26. The cutouts 28 are positioned to couple to the first pin 26 to prevent rotation of the second tube 22 relative to the first tube 20.

A third tube 32 is fluidically coupled to and extends between opposing sides 34 of the first frame 14. The third tube 32 is positioned proximate to a second end 36 of the base 12. A fourth tube 38 is fluidically coupled to and extends angularly between the third tube 32 and the first tube 20. The fourth tube 38 is positioned to brace the first tube 20.

Each of a pair of fifth tubes 40 is coupled to and extends angularly between a respective front corner 42 of the first frame 14 and the first tube 20. Each fifth tube 40 is positioned to brace the first tube 20.

A first port 44 is positioned in the fourth tube 38. The first port 44 is configured to insert a substance, such as water and sand, into the first frame 14 to weight the first frame 14. A first plug 46 is selectively couplable to the third tube 32 to selectively open and close the first port 44.

A second port 48 is positioned in the first frame 14. The second port 48 is configured to drain the substance from the first frame 14. The second port 48 is positioned in the second end 36 equally distant from the opposing sides 34 of the first frame 14. A second plug 50 is selectively couplable to the first frame 14 to selectively open and close the second port 48.

A first rod 52 is coupled to and extends perpendicularly from an upper end 54 of the nested rods 16. The first rod 52 is opposing to the base 12. A coupler 56 is coupled to and extends downwardly from the first rod 52 distal from the nested rods 16. The coupler 56 is configured to selectively couple to a volleyball to position the volleyball to be spiked by a user.

In one embodiment, the coupler 56 comprises a second frame 58. The second frame 58 is substantially rectangularly shaped. A first cord 60 is coupled to and extends between a top 62 of the second frame 58 and the first rod 52. The first cord 60 is positioned on the second frame 58 so that the second frame 58 is configured to swing relative to the first rod 52. A gap 64 is positioned in a bottom 66 of the second frame 58 so that the second frame 58 is deformable. The gap 64 is substantially complementary to a diameter of the volleyball. The gap 64 is configured to be widened to insert the volleyball and to rebound to couple the volleyball to the second frame 58.

In another embodiment, a first fastener 68 is coupled to the fourth tube 38 and a second cord 70 is coupled to the second frame 58. The second cord 70 is selectively couplable to the first fastener 68. The second cord 70 is positioned to couple to the first fastener 68 to stabilize the second frame 58 so that the second frame 58 is substantially coplanar with the first rod 52.

A lattice 72 is selectively couplable to and extends from the plurality of nested rods 16. The lattice 72 is selectively positionable between the base 12 and the coupler 56. The lattice 72 is configured to simulate a volleyball net.

In one embodiment, the lattice 72 comprises a second rod 74 that is selectively couplable to the plurality of nested rods 16. A third rod 76 is coupled to and extends perpendicularly from the second rod 74. The third rod 76 is positioned proximate to an upper terminus 78 of the second rod 74. A fourth rod 80 is coupled to and extends perpendicularly from the third rod 76. Each of a plurality of ropes 82 is coupled to and extends between the fourth rod 80 and the second rod 74. The ropes 82 are parallel to the third rod 76. In another embodiment, the plurality of ropes 82 comprises four ropes 82.

A pair of first extenders 84 is coupled to and extends from the first tube 20. A sixth tube 86 is coupled to each of the first extenders 84. The sixth tube 86 are parallel to the first tube 20. The sixth tube 86 is complementary to the second rod 74. The sixth tube 86 is positioned to selectively insert the second rod 74. The sixth tube 86 is positioned to insert the second rod 74 so that the lattice 72 is selectively positionable at a respective height for a user.

A first orifice 88 is positioned through the sixth tube 86. A plurality of holes 90 is positioned through the second rod 74. The holes 90 are complementary to the first orifice 88. Each hole 90 is positioned to be selectively aligned with the first orifice 88 to insert a second pin 92 to fixedly position the lattice 72 at the respective height for the user. The second pin 92 is complementary to the holes 90 and the first orifice 88.

A second orifice 94 is positioned through the second pin 92. The second orifice 94 is positioned to insert a clip 96 to couple the second rod 74 to the sixth tube 86. The clip 96 is complementary to the second orifice 94.

A pair of second extenders 98 is coupled to and extends from the sixth tube 86. The second extenders 98 are positioned proximate to a lower end 100 of the sixth tube 86. A seventh tube 102 is coupled to each of the second extenders 98. The seventh tube 102 is parallel to the first tube 20. The seventh tube 102 is complementary to the second rod 74. The seventh tube 102 is positioned to selectively insert the second rod 74. The seventh tube 102 is positioned to insert the second rod 74 so that the lattice 72 is selectively positionable at a respective height for a younger user.

A third orifice 104 is positioned through the seventh tube 102. Each hole 90 that is positioned in the second rod 74 is positioned to be selectively aligned with the second orifice 94 to insert the second pin 92 to fixedly position the lattice 72 at the respective height for the younger user.

A first pulley 106 is coupled to the first rod 52 distal from the plurality of nested rods 16. A second pulley 108 is coupled to the first rod 52 proximate to the plurality of nested rods 16. At least one second fastener 110 is coupled to a respective first extender 84. The first cord 60 is selectively couplable to the at least one second fastener 110. The first cord 60 is positioned through the first pulley 106 and the second pulley 108. The first cord 60 is configured to selectively position the second frame 58 relative to the first rod 52. The first cord 60 also is positioned to couple to the at least one second fastener 110 to fixedly position the second frame 58 at a respective distance from the first rod 52. In one embodiment, the at least one second fastener 110 comprises a pair of eye bolts 112 that is opposingly positioned on the respective first extender 84.

A third pipe 114 is coupled to and extends perpendicularly from the respective first extender 84. The third pipe 114 is positioned proximate to the at least one second fastener 110. A notch 116 is positioned in the third pipe 114 distal from the respective first extender 84. The notch 116 is complementary to the first cord 60. The notch 116 is positioned to insert the first cord 60 to position the first cord 60 transversely from the plurality of nested rods 16.

In use, the first port 44 that is positioned in the fourth tube 38 is configured to insert the substance, such as the water and the sand, into the first frame 14 to weight the first frame 14. The second port 48 that is positioned in the first frame 14 is configured to drain the substance from the first frame 14. Each penetration 24 that is positioned in the second tube 22 is positioned to insert the first pin 26 to fixedly position the plurality of nested rods 16 at the respective height. The cutouts 28 that are positioned in the first tube 20 are positioned to couple to the first pin 26 to prevent rotation of the second tube 22 relative to the first tube 20. The sixth tube 86 is positioned to insert the second rod 74. Each hole 90 that is positioned in the second rod 74 is positioned to be selectively aligned with the first orifice 88, which is positioned in the sixth tube 86, to insert the second pin 92. The lattice 72 is fixedly positioned at the respective height for the user. The second orifice 94 that is positioned in the second pin 92 is positioned to insert the clip 96 to couple the second rod 74 to the sixth tube 86. The seventh tube 102 is positioned to insert the second rod 74. Each hole 90 that is positioned in the second rod 74 is positioned to be selectively aligned with the second orifice 94 to insert the second pin 92. The lattice 72 is fixedly positioned at the respective height for the younger user. The second orifice 94 that is positioned in the second pin 92 is positioned to insert the clip 96 to couple the second rod 74 to the seventh tube 102. The first cord 60, which is positioned through the first pulley 106 and the second pulley 108, is configured to selectively position the second frame 58 relative to the first rod 52. The first cord 60 also is positioned to couple to the at least one second fastener 110 to fixedly position the second frame 58 at the respective distance from the first rod 52. The second frame 58 is configured to swing relative to the first rod 52. The gap 64 that is positioned in the second frame 58 is configured to be widened to insert the volleyball. The gap 64 is configured to rebound to couple the volleyball to the second frame 58. The second cord 70 that is positioned on the second frame 58 is positioned to couple to the first fastener 68 to stabilize the second frame 58. The second frame 58 is substantially coplanar with the first rod 52.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A volleyball training device comprising:

a base configured for positioning on a substantially horizontal surface, said base comprising a first frame, said first frame being tubular, said first frame being substantially rectangularly shaped;

a plurality of nested rods coupled to and extending perpendicularly from a first end of said base such that said plurality of nested rods is selectively vertically extensible, said plurality of nested rods comprising a first tube and a second tube, said first tube being fluidically coupled to said first frame, said second tube being selectively extensible from said first tube;

a first rod coupled to and extending perpendicularly from an upper end of said nested rods, said first rod being opposing to said base;

a coupler coupled to and extending downwardly from said first rod distal from said nested rods, said coupler being configured for selectively coupling to a volleyball;

a lattice selectively couplable to and extending from said plurality of nested rods such that said lattice is selectively positionable between said base and said coupler, said lattice comprising a second rod selectively couplable to said plurality of nested rods;

a third rod coupled to and extending perpendicularly from said second rod, said third rod being positioned proximate to an upper terminus of said second rod;

a fourth rod coupled to and extending perpendicularly from said third rod; and a plurality of ropes, each said rope being coupled to and extending between said fourth rod and said second rod such that said rope is parallel to said third rod; and wherein said coupler is positioned on said first rod such that said coupler is configured for coupling to the volleyball positioning the volleyball for spiking by a user, wherein said lattice is positioned on said nested rods such that said lattice is configured for simulating a volleyball net.

2. The device of claim 1, further comprising:

a plurality of penetrations positioned through said second tube;

a first pin complementary to said penetrations;

a pair of cutouts opposingly positioned in an upper endpoint of said first tube, said cutouts being complementary to said first pin; and wherein said penetrations are positioned in said second tube such that each said penetration is positioned for inserting said first pin for fixedly positioning said plurality of nested rods at a respective height, wherein said cutouts are positioned in said first tube such that said cutouts are positioned for coupling to said first pin for preventing rotation of said second tube relative to said first tube.

3. The device of claim 1, further comprising:

a third tube fluidically coupled to and extending between opposing sides of said first frame, said third tube being positioned proximate to a second end of said base;

a fourth tube fluidically coupled to and extending angularly between said third tube and said first tube;

a pair of fifth tubes, each said fifth tube being coupled to and extending angularly between a respective front corner of said first frame and said first tube; and wherein said fourth tube is positioned on said third tube and said first tube such that said fourth tube is positioned for bracing said first tube, wherein said fifth tubes positioned on said third tube and said first frame such that each said fifth tube is positioned for bracing said first tube.

4. The device of claim 3, further comprising:

a first port positioned in said fourth tube;

a first plug selectively couplable to said third tube for selectively opening and closing said first port;

a second port positioned in said first frame, said second port being positioned in said second end equally distant from said opposing sides of said first frame;

a second plug selectively couplable to said first frame for selectively opening and closing said second port; and wherein said first port is positioned in said fourth tube such that said first port is configured for inserting a substance, such as water and sand, into said first frame for weighting said first frame, wherein said second port is positioned in said first frame such that said second port is configured for draining the substance from said first frame.

5. The device of claim 1, further including said plurality of ropes comprising four said ropes.

6. A volleyball training device comprising:

a base configured for positioning on a substantially horizontal surface, said base comprising a first frame, said first frame being tubular, said first frame being substantially rectangularly shaped;

a plurality of nested rods coupled to and extending perpendicularly from a first end of said base such that said plurality of nested rods is selectively vertically extensible, said plurality of nested rods comprising a first tube and a second tube, said first tube being fluidically coupled to said first frame, said second tube being selectively extensible from said first tube;

a first rod coupled to and extending perpendicularly from an upper end of said nested rods, said first rod being opposing to said base;

a coupler coupled to and extending downwardly from said first rod distal from said nested rods, said coupler being configured for selectively coupling to a volleyball;

a lattice selectively couplable to and extending from said plurality of nested rods such that said lattice is selectively positionable between said base and said coupler;

wherein said coupler is positioned on said first rod such that said coupler is configured for coupling to the volleyball positioning the volleyball for spiking by a user, wherein said lattice is positioned on said nested rods such that said lattice is configured for simulating a volleyball net;

a third tube fluidically coupled to and extending between opposing sides of said first frame, said third tube being positioned proximate to a second end of said base;

a fourth tube fluidically coupled to and extending angularly between said third tube and said first tube;

a pair of fifth tubes, each said fifth tube being coupled to and extending angularly between a respective front corner of said first frame and said first tube; and wherein said fourth tube is positioned on said third tube and said first tube such that said fourth tube is positioned for bracing said first tube, wherein said fifth tubes positioned on said third tube and said first frame such that each said fifth tube is positioned for bracing said first tube;

said coupler comprising:

a second frame, said second frame being substantially rectangularly shaped;

a first cord coupled to and extending between a top of said second frame and said first rod;

a gap positioned in a bottom of said second frame such that said second frame is deformable, said gap being substantially complementary to a diameter of the volleyball; and wherein said first cord is positioned on said second frame such that said second frame is configured for swinging relative to said first rod, wherein said gap is positioned in said second frame such that said gap is configured for widening for inserting the volleyball and for rebounding for coupling the volleyball to said second frame.

7. The device of claim 6, further comprising:

a first fastener coupled to said fourth tube;

a second cord coupled to said second frame, said second cord being selectively couplable to said first fastener; and wherein said second cord is positioned on said second frame such that said second cord is positioned for coupling to said first fastener for stabilizing said second frame such that said second frame is substantially coplanar with said first rod.

8. The device of claim 6, further comprising:

a pair of first extenders coupled to and extending from said first tube;

a sixth tube, said sixth tube being coupled to each of said first extenders such that said sixth tube is parallel to said first tube, said sixth tube being complementary to said second rod such that said sixth tube is positioned for selectively inserting said second rod; and wherein said sixth tube is positioned on said first extenders such that said sixth tube is positioned for inserting said second rod such that said lattice is selectively positionable at a respective height for a user.

9. The device of claim 8, further comprising:

a first orifice positioned through said sixth tube;

a plurality of holes positioned through said second rod, said holes being complementary to said first orifice;

a second pin complementary to said holes and said first orifice;

a second orifice positioned through said second pin;

a clip complementary to said second orifice; and wherein said holes are positioned in said second rod such that each said hole is positioned for selectively aligning with said first orifice for inserting said second pin for fixedly positioning said lattice at the respective height for the user, wherein said second orifice is positioned in said second pin such that said second orifice is positioned for inserting said clip for coupling said second rod to said sixth tube.

10. The device of claim 9, further comprising:

a pair of second extenders coupled to and extending from said sixth tube, said second extenders being positioned proximate to a lower end of said sixth tube;

a seventh tube, said seventh tube being coupled to each of said second extenders such that said seventh tube is parallel to said first tube, said seventh tube being complementary to said second rod such that said seventh tube is positioned for selectively inserting said second rod;

a third orifice positioned through said seventh tube; and wherein said seventh tube is positioned on said second extenders such that said seventh tube is positioned for inserting said second rod such that said lattice is selectively positionable at a respective height for a younger user, wherein said holes are positioned in said second rod such that each said hole is positioned for selectively aligning with said second orifice for inserting said second pin for fixedly positioning said lattice at the respective height for the younger user.

11. The device of claim 8, further comprising:

a first pulley coupled to said first rod distal from said plurality of nested rods;

a second pulley coupled to said first rod proximate to said plurality of nested rods;

at least one second fastener coupled to a respective said first extender, said first cord being selectively couplable to said at least one second fastener, said first cord being positioned through said first pulley and said second pulley; and wherein said first cord is positioned through said first pulley and said second pulley such that said first cord is configured for selectively positioning said second frame relative to said first rod and for coupling to said at least one second fastener for fixedly positioning said second frame at a respective distance from said first rod.

12. The device of claim 11, further including said at least one second fastener comprising a pair of eye bolts opposingly positioned on said respective said first extender.

13. The device of claim 8, further comprising:

a third pipe coupled to and extending perpendicularly from said respective said first extender, said third pipe being positioned proximate to said at least one second fastener;

a notch positioned in said third pipe distal from said respective said first extender, said notch being complementary to said first cord; and wherein said notch is positioned in said third pipe such that said notch is positioned for inserting said first cord for positioning said first cord transversely from said plurality of nested rods.

14. A volleyball training device comprising:

a base configured for positioning on a substantially horizontal surface, said base comprising a first frame, said first frame being tubular, said first frame being substantially rectangularly shaped;

a plurality of nested rods coupled to and extending perpendicularly from a first end of said base such that said plurality of nested rods is selectively vertically extensible, said plurality of nested rods comprising a first tube and a second tube, said first tube being fluidically coupled to said first frame, said second tube being selectively extensible from said first tube;

a plurality of penetrations positioned through said second tube;

a first pin complementary to said penetrations, wherein said penetrations are positioned in said second tube such that each said penetration is positioned for inserting said first pin for fixedly positioning said plurality of nested rods at a respective height;

a pair of cutouts opposingly positioned in an upper endpoint of said first tube, said cutouts being complementary to said first pin, wherein said cutouts are positioned in said first tube such that said cutouts are positioned for coupling to said first pin for preventing rotation of said second tube relative to said first tube;

a third tube fluidically coupled to and extending between opposing sides of said first frame, said third tube being positioned proximate to a second end of said base;

a fourth tube fluidically coupled to and extending angularly between said third tube and said first tube, wherein said fourth tube is positioned on said third tube and said first tube such that said fourth tube is positioned for bracing said first tube;

a pair of fifth tubes, each said fifth tube being coupled to and extending angularly between a respective front corner of said first frame and said first tube, wherein said fifth tubes positioned on said third tube and said first frame such that each said fifth tube is positioned for bracing said first tube;

a first port positioned in said fourth tube, wherein said first port is positioned in said fourth tube such that said first port is configured for inserting a substance, such as water and sand, into said first frame for weighting said first frame;

a first plug selectively couplable to said third tube for selectively opening and closing said first port;

a second port positioned in said first frame, wherein said second port is positioned in said first frame such that said second port is configured for draining the substance from said first frame, said second port being positioned in said second end equally distant from said opposing sides of said first frame;

a second plug selectively couplable to said first frame for selectively opening and closing said second port;

a first rod coupled to and extending perpendicularly from an upper end of said nested rods, said first rod being opposing to said base, a coupler coupled to and extending downwardly from said first rod distal from said nested rods, said coupler being configured for selectively coupling to a volleyball, wherein said coupler is positioned on said first rod such that said coupler is configured for coupling to the volleyball positioning the volleyball for spiking by a user, said coupler comprising:

a second frame, said second frame being substantially rectangularly shaped, a first cord coupled to and extending between a top of said second frame and said first rod, wherein said first cord is positioned on said second frame such that said second frame is configured for swinging relative to said first rod, a gap positioned in a bottom of said second frame such that said second frame is deformable, said gap being substantially complementary to a diameter of the volleyball, wherein said gap is positioned in said second frame such that said gap is configured for widening for inserting the volleyball and for rebounding for coupling the volleyball to said second frame, a first fastener coupled to said fourth tube, and a second cord coupled to said second frame, said second cord being selectively couplable to said first fastener, wherein said second cord is positioned on said second frame such that said second cord is positioned for coupling to said first fastener for stabilizing said second frame such that said second frame is substantially coplanar with said first rod;

a lattice selectively couplable to and extending from said plurality of nested rods such that said lattice is selectively positionable between said base and said coupler, wherein said lattice is positioned on said nested rods such that said lattice is configured for simulating a volleyball net, said lattice comprising:

a second rod selectively couplable to said plurality of nested rods, a third rod coupled to and extending perpendicularly from said second rod, said third rod being positioned proximate to an upper terminus of said second rod, a fourth rod coupled to and extending perpendicularly from said third rod, and a plurality of ropes, each said rope being coupled to and extending between said fourth rod and said second rod such that said rope is parallel to said third rod, said plurality of ropes comprising four said ropes;

a pair of first extenders coupled to and extending from said first tube;

a sixth tube, said sixth tube being coupled to each of said first extenders such that said sixth tube is parallel to said first tube, said sixth tube being complementary to said second rod such that said sixth tube is positioned for selectively inserting said second rod, wherein said sixth tube is positioned on said first extenders such that said sixth tube is positioned for inserting said second rod such that said lattice is selectively positionable at a respective height for a user;

a first orifice positioned through said sixth tube;

a plurality of holes positioned through said second rod, said holes being complementary to said first orifice;

a second pin complementary to said holes and said first orifice, wherein said holes are positioned in said second rod such that each said hole is positioned for selectively aligning with said first orifice for inserting said second pin for fixedly positioning said lattice at the respective height for the user;

a second orifice positioned through said second pin;

a clip complementary to said second orifice, wherein said second orifice is positioned in said second pin such that said second orifice is positioned for inserting said clip for coupling said second rod to said sixth tube;

a pair of second extenders coupled to and extending from said sixth tube, said second extenders being positioned proximate to a lower end of said sixth tube;

a seventh tube, said seventh tube being coupled to each of said second extenders such that said seventh tube is parallel to said first tube, said seventh tube being complementary to said second rod such that said seventh tube is positioned for selectively inserting said second rod, wherein said seventh tube is positioned on said second extenders such that said seventh tube is positioned for inserting said second rod such that said lattice is selectively positionable at a respective height for a younger user;

a third orifice positioned through said seventh tube, wherein said holes are positioned in said second rod such that each said hole is positioned for selectively aligning with said second orifice for inserting said second pin for fixedly positioning said lattice at the respective height for the younger user;

a first pulley coupled to said first rod distal from said plurality of nested rods;

a second pulley coupled to said first rod proximate to said plurality of nested rods;

at least one second fastener coupled to a respective said first extender, said first cord being selectively couplable to said at least one second fastener, said first cord being positioned through said first pulley and said second pulley, wherein said first cord is positioned through said first pulley and said second pulley such that said first cord is configured for selectively positioning said second frame relative to said first rod and for coupling to said at least one second fastener for fixedly positioning said second frame at a respective distance from said first rod, said at least one second fastener comprising a pair of eye bolts opposingly positioned on said respective said first extender;

a third pipe coupled to and extending perpendicularly from said respective said first extender, said third pipe being positioned proximate to said at least one second fastener;

a notch positioned in said third pipe distal from said respective said first extender, said notch being complementary to said first cord, wherein said notch is positioned in said third pipe such that said notch is positioned for inserting said first cord for positioning said first cord transversely from said plurality of nested rods; and wherein said first port is positioned in said fourth tube such that said first port is configured for inserting the substance, such as the water and the sand, into said first frame for weighting said first frame, wherein said second port is positioned in said first frame such that said second port is configured for draining the substance from said first frame, wherein said penetrations are positioned in said second tube such that each said penetration is positioned for inserting said first pin for fixedly positioning said plurality of nested rods at the respective height, wherein said cutouts are positioned in said first tube such that said cutouts are positioned for coupling to said first pin for preventing rotation of said second tube relative to said first tube, wherein said sixth tube is positioned on said first extenders such that said sixth tube is positioned for inserting said second rod, wherein said holes are positioned in said second rod such that each said hole is positioned for selectively aligning with said first orifice positioned in said sixth tube for inserting said second pin for fixedly positioning said lattice at the respective height for the user, wherein said second orifice is positioned in said second pin such that said second orifice is positioned for inserting said clip for coupling said second rod to said sixth tube, wherein said seventh tube is positioned on said second extenders such that said seventh tube is positioned for inserting said second rod, wherein said holes are positioned in said second rod such that each said hole is positioned for selectively aligning with said second orifice for inserting said second pin for fixedly positioning said lattice at the respective height for the younger user, wherein said second orifice is positioned in said second pin such that said second orifice is positioned for inserting said clip for coupling said second rod to said seventh tube, wherein said first cord is positioned through said first pulley and said second pulley such that said first cord is configured for selectively positioning said second frame relative to said first rod and for coupling to said at least one second fastener for fixedly positioning said second frame at the respective distance from said first rod, wherein said first cord is positioned on said second frame such that said second frame is configured for swinging relative to said first rod, wherein said gap is positioned in said second frame such that said gap is configured for widening for inserting the volleyball and for rebounding for coupling the volleyball to said second frame, wherein said second cord is positioned on said second frame such that said second cord is positioned for coupling to said first fastener for stabilizing said second frame such that said second frame is substantially coplanar with said first rod.

* * * * *